US006704530B2

(12) United States Patent
Yoo

(10) Patent No.: US 6,704,530 B2
(45) Date of Patent: Mar. 9, 2004

(54) METHOD FOR FORMING IMAGE IN ELECTROPHOTOGRAPHIC PRINTER

(75) Inventor: Yong-baek Yoo, Suwon-si (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/133,453

(22) Filed: Apr. 29, 2002

(65) Prior Publication Data

US 2003/0129002 A1 Jul. 10, 2003

(30) Foreign Application Priority Data

Jan. 10, 2002 (KR) ..... 2002-1380

(51) Int. Cl.[7] ..... G03G 15/01
(52) U.S. Cl. ..... 399/228; 399/223
(58) Field of Search ..... 399/53, 111, 222, 399/223, 226, 227, 228, 265, 279; 347/140

(56) References Cited

U.S. PATENT DOCUMENTS 4,939,547 A * 7/1990 Miyaji et al. ..... 399/228
5,440,377 A * 8/1995 Izawa et al. ..... 399/223 X
5,600,431 A * 2/1997 Takeda et al. ..... 399/226
5,749,031 A * 5/1998 Miwa et al. ..... 399/228
5,822,650 A * 10/1998 Noda et al. ..... 399/53
6,317,572 B1 * 11/2001 Miyabe et al. ..... 399/111
6,535,708 B2 * 3/2003 Hashimoto et al. ..... 399/228

FOREIGN PATENT DOCUMENTS

JP 11-149217 * 6/1999
JP 2000-066476 * 3/2000

* cited by examiner

*Primary Examiner*—Sandra L Brase
(74) *Attorney, Agent, or Firm*—Sughrue Mion, PLLC

(57) ABSTRACT

A method for forming an image in an electrophotographic printer. The method includes the steps of rotating a developing roller at the same linear velocity as that of a photosensitive medium in a state where the developing roller is separated from the photosensitive medium, moving a developer so that the developing roller is in contact with the photosensitive medium, and changing the linear velocity of the developing roller to be faster than that of the photosensitive medium after contact and proceeding with the developing process, rotating the developing roller at the same linear velocity as that of the photosensitive medium after completing the developing process, and moving the developer so that the developing roller is separated from the photosensitive medium. The linear velocity of the developing roller is equalized with that of the photosensitive drum whenever the developing roller is attached to or detached from the photosensitive medium, the toner supply to the photosensitive medium during development is sufficient, and shock caused by the attaching and detaching operation is alleviated, thereby greatly reducing the possibility of defective images.

4 Claims, 5 Drawing Sheets

METHOD FOR FORMING IMAGE IN ELECTROPHOTOGRAPHIC PRINTER

BACKGROUND OF THE INVENTION

1. Field of the Invention

The present invention relates to a method for forming an image in an electrophotographic printer, and more particularly, to a method for forming an image in an image forming system in which a developing unit is attached and detached from a photosensitive medium and developing proceeds. The present application is based on Korean Application No. 2002-1380, filed Jan. 10, 2002, which is incorporated herein by reference.

2. Description of the Related Art

In general, an electrophotographic printer such as a color laser printer, has an image forming system in which an electrostatic latent image is formed on a photosensitive medium and then, the electrostatic latent image is developed with a toner, and a developed image passes through a predetermined transferring medium and is transferred onto a paper, and then, the developed image is heated and pressed, and the heated and pressed image is finally fixed on the paper.

FIG. 1 illustrates an example of an image forming system of an electrophotographic printer.

The image forming system includes a photosensitive drum 10 as a photosensitive medium, a charger 11 for charging the photosensitive drum 10, a laser scanning unit 12 as an exposure unit, for scanning light on the electrified photosensitive drum 10 and forming an electrostatic latent image, a developing unit 13 for developing the electrostatic latent image with a toner having four colors such as yellow (Y), magenta (M), cyan (C), and black (K), a transferring belt 14 for sequentially overlapping the four color images which are developed on the photosensitive drum 10, a first transferring roller 14*a* for transferring the image which is developed on the photosensitive drum 10 to the transferring belt 14, a second transferring roller 14*b* for transferring an image which overlaps four colors on the transferring belt 14 onto the paper, and a fixing unit 15 for heating and pressing the print and fixing the transferred image. Four-color developers 13-Y, 13-M, 13-C, and 13-K, which are included in the developing unit 13, are elastically biased by a spring (not shown) in a direction where they are separated from the photosensitive drum 10. The four color developers selectively move toward the photosensitive drum 10 through the rotation of a cam 13*b*, so that developing rollers 13*a* which are provided at the front end of the color developers contact the photosensitive drum 10. Reference numerals 16, 17, 18, and 19 denote a paper cassette, a blade for cleaning a photosensitive drum, an anti-electrostatic unit, and a transfer path through which the paper is discharged, respectively.

In the above structure, an image forming process is performed as described below. First, in a case where the photosensitive drum 10 is charged by the charger 11, the laser scanning unit (LSU) 12 scans light and thus forms the electrostatic latent image of an image which is to be developed as a first color. For example, in a case where a yellow color is developed as the first color, as shown in FIG. 2, the developer 13-Y with a yellow color is moved to the photosensitive drum 10 by the action of a corresponding cam 13*b*-Y and thus the electrostatic latent image formed on the photosensitive drum 10 is developed as a yellow toner.

FIG. 3 illustrates the state where the photosensitive drum 10 is in contact with a developing roller 13*a*-Y of the developer 13-Y. In FIG. 3, a toner T which is stained at the outside circumferential side of the developing roller 13*a*-Y is moved onto the portion of the electrostatic latent image of the photosensitive drum 10 contacting the toner T. In such a case, the developing roller 13*a*-Y rotates at a linear velocity which is faster than the linear velocity of the photosensitive drum 10 so as to increase the amount of a toner per area with which the photosensitive drum 10 is coated. The yellow image developed thereby is firstly transferred to the transferring belt 14 through a first transferring nip N1.

Next, an electrostatic latent image for a second color is formed through charging and exposure of the photosensitive drum 10. In a case where the second color is magenta, as shown in FIG. 4, the developer 13-M is moved to the photosensitive drum 10 and thus the electrostatic latent image is formed. The magenta image developed thereby is overlapped and transferred to the transferring belt 14 to which the yellow image is transferred.

A cyan image for a third color and a black image for a fourth color are developed and transferred in the same way, and thereby an image having a desired color is finally made on the transferring belt 14.

After that, the color image made thereby is transferred onto the paper which is supplied to a second transferring nip N2 between the transferring belt 14 and the second transferring roller 14*b*. The transferred image passes through the fixing unit 15, where it is heated and pressed and thus is completely fixed on the paper.

However, in the above configuration, since the four-color developers 13-Y, 13-M, 13-C, and 13-K of the developing unit 13 forms images while being alternately attached and detached from the photosensitive drum 10, the photosensitive drum 10 may be shocked whenever each of the developing rollers 13*a* of each of the developers 13-Y, 13-M, 13-C, and 13-K collides with the photosensitive drum. In such a case, jitter errors caused by image tremble during collision may occur. However, a problem arises in that each of the developing rollers 13*a* of each of the developers 13-Y, 13-M, 13-C, and 13-K rotates at a linear velocity which is faster than that of the photosensitive drum 10 as mentioned above, and thus shock caused by a difference in the linear velocity occurs during contact, and thereby the shock applied to the photosensitive drum 10 is further increased.

That is, a photosensitive layer is usually coated on an aluminum material to form the photosensitive drum 10, and the developing rollers 13*a* have a rubber material of predetermined hardness. Thus, in a case where the hardness of the rubber material is lowered, shock during contact may be slightly alleviated. However, the difference in the linear velocity described above is set so that the toner is sufficiently supplied to the photosensitive drum 10. In a case where the developing roller 13*a* and the photosensitive drum 10, which have different linear velocities, contact each other, the developers 13-Y, 13-M, 13-C, and 13-K are instantaneously pushed during contact, and thus registration defects in which the overlapping position between colors crosses each other, as well as the jitter errors occur, and thereby an image is not clear and abnormally developed.

In addition, due to shock during contact, the toner scatters and thus contaminates peripheral devices. The problem caused by the difference in linear velocities may occur during break off as well as during contact. In a case where the velocity of the developing roller is reduced continuously, the supply of the toner is insufficient during development, and thus image quality may be lowered.

Thus, for developing of a clear image, a method is needed in which the amount of the toner supplied to the photosensitive drum 10 during development is not reduced, and the above causes for the occurrence of defective images are eliminated.

SUMMARY OF THE INVENTION

To solve the above problems, it is an object of the present invention to provide a method for forming an image in an electrophotographic printer which is improved so that shock is alleviated when a photosensitive medium and a developer contact each other.

Accordingly, to achieve the above object, there is provided a method for forming an image in an electrophotographic printer, which is capable of removing a developing roller of a developer from a photosensitive medium on which an electrostatic latent image is formed, and of developing the electrostatic latent image with a predetermined color. The method includes the steps of rotating a developing roller at the same linear velocity as that of a photosensitive medium in a state where the developing roller is separated from the photosensitive medium, moving a developer so that the developing roller is in contact with the photosensitive medium, and changing the linear velocity of the developing roller to be faster than that of the photosensitive medium after contact and then proceeding with the developing process.

Here, in order to alleviate shock caused when the developing roller is detached, it is preferable that the method further includes the steps of rotating the developing roller at the same linear velocity as that of the photosensitive medium after completing developing, and moving the developer so that the developing roller is separated from the photosensitive medium.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
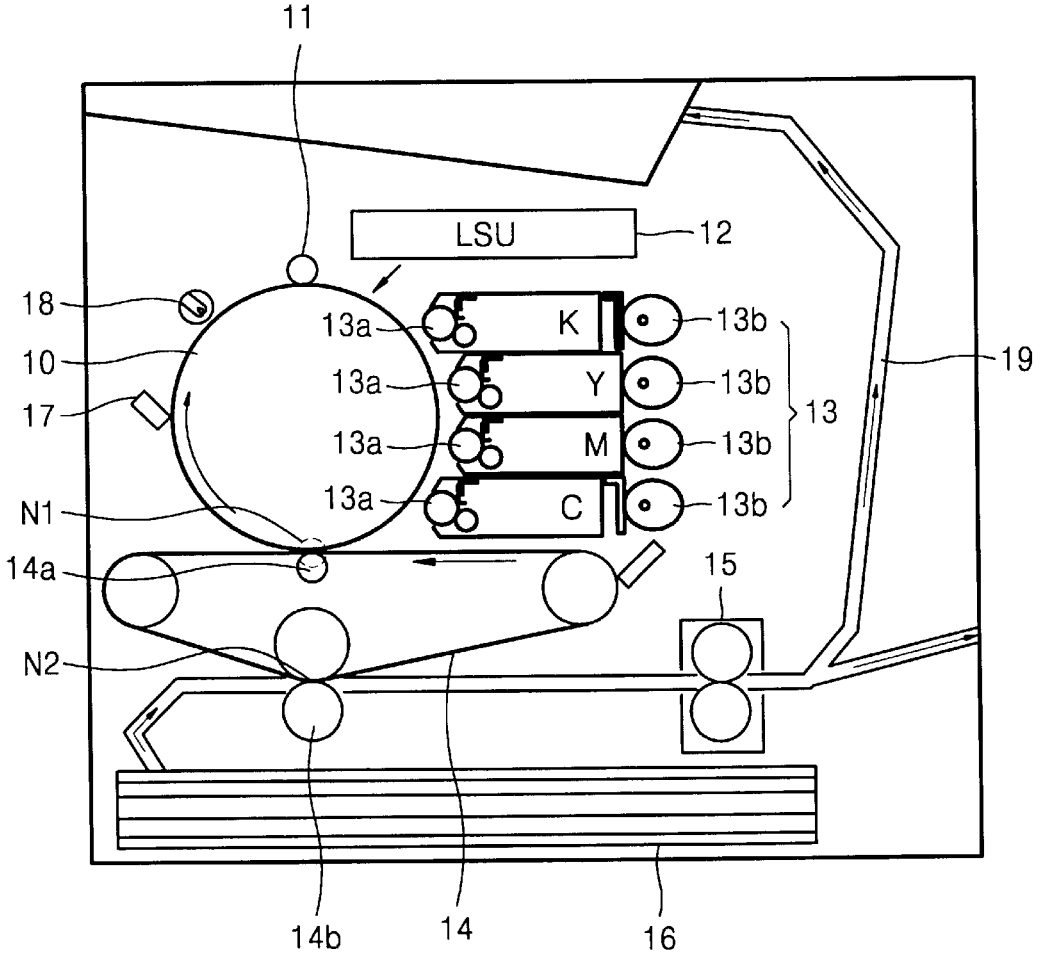
FIG. 1 (PRIOR ART)
FIG. 1 illustrates an image forming system of a conventional electrophotographic printer.
Figure 2:
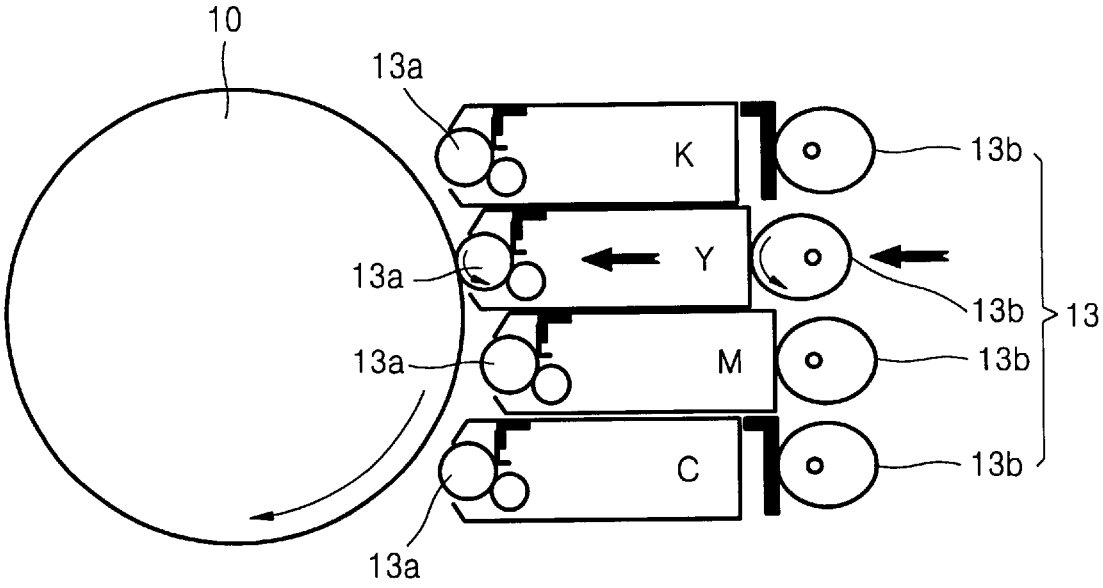
FIG. 2 (PRIOR ART)
FIGS. 2 through 4 illustrate the attaching and detaching operation of a developing unit of the image forming system shown in FIG. 1.
Figure 3:
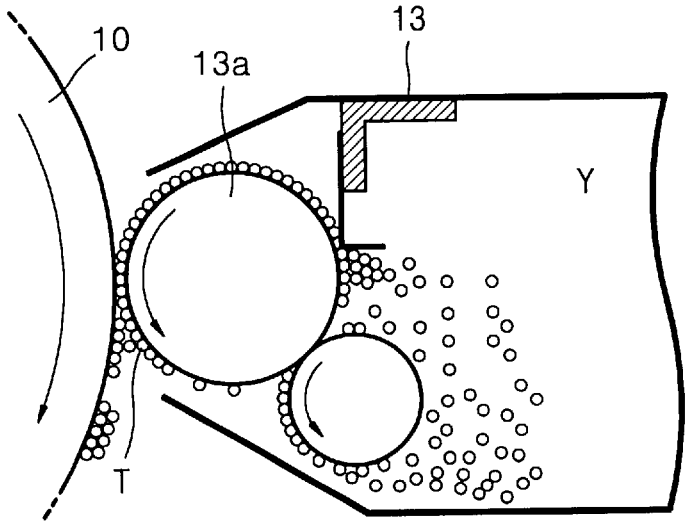
FIG. 3 (PRIOR ART)
Figure 4:
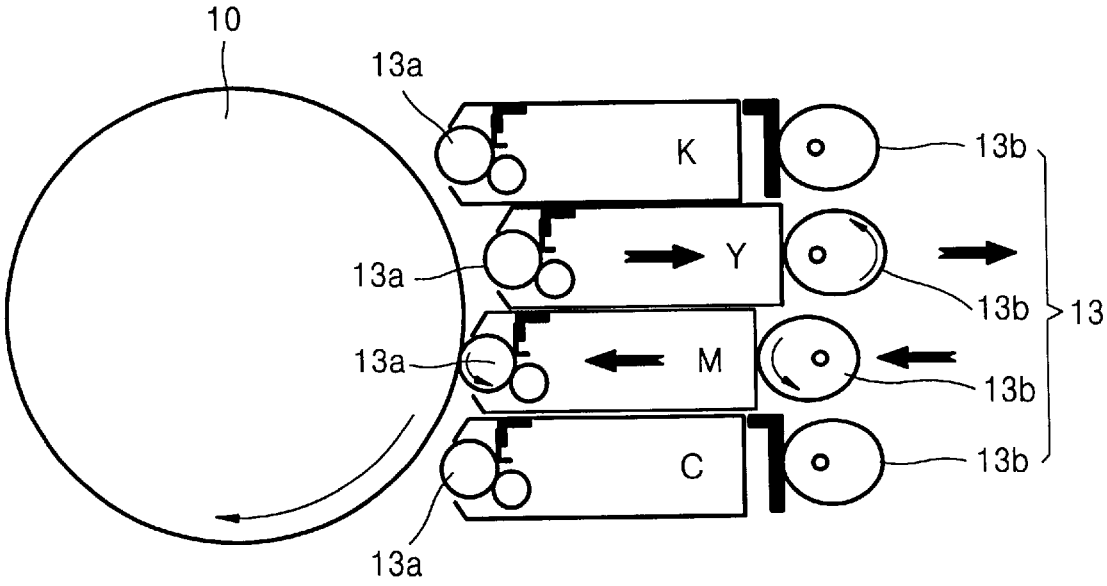
FIG. 4 (PRIOR ART)
Figure 5A:
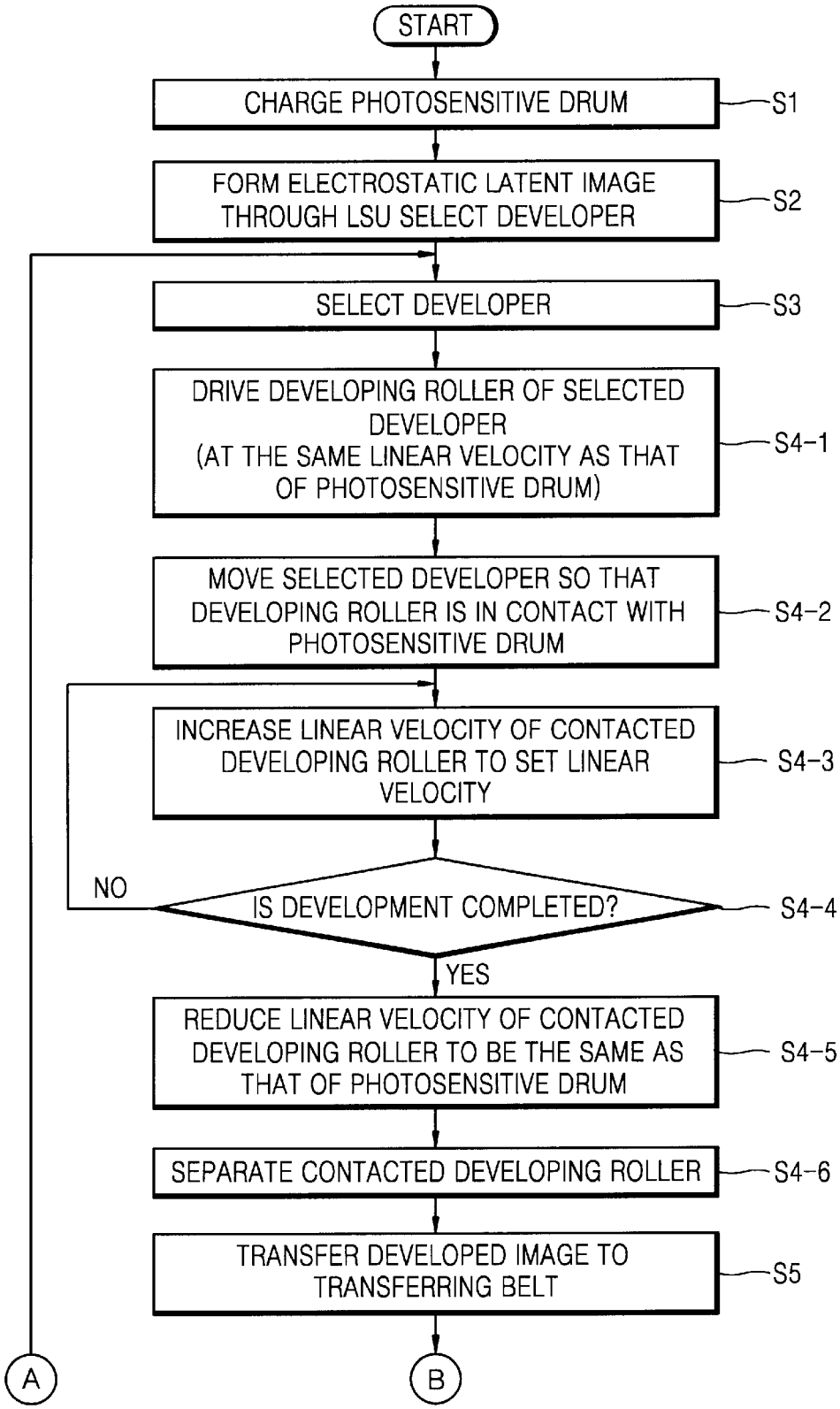
FIGS. 5A and 5B constitute a flow chart illustrating a method for forming an image in an electrophotographic printer according to the present invention.
Figure 5B:
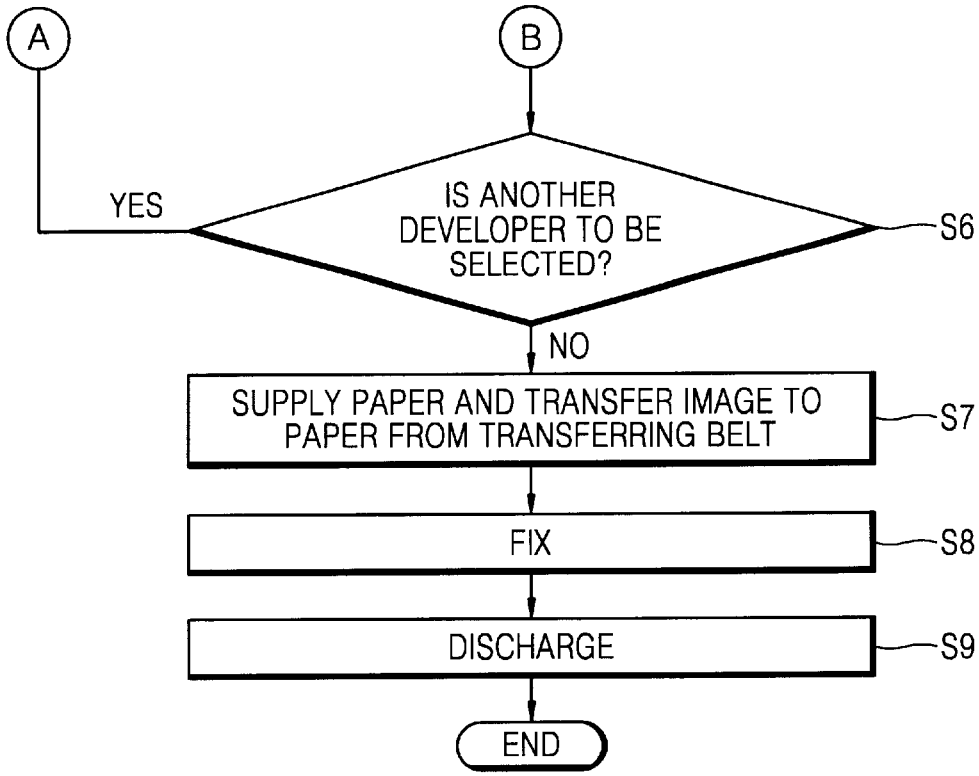

FIGS. 5A and 5B constitute a flow chart illustrating a method for forming an image in an electrophotographic printer according to the present invention. Hereinafter, the method for forming an image in an electrophotographic printer according to the present invention will be described with reference to the image forming system shown in FIG. 1 and the flow chart of FIGS. 5A and 5B.

In step S1, the charger 11 charges the photosensitive drum 10 as a photosensitive medium, to a predetermined electric potential. In step S2, the LSU 12 scans light to the charged photosensitive drum 10 and thus forms an electrostatic latent image corresponding to an image for a first color (for example, yellow). In step S3, the electrostatic latent image is developed first by one of the four developers of the developing unit 13. For example, in step S4-1, in a case where the electrostatic latent image is developed by the yellow developer 13-Y, a printer controller (not shown) for controlling an image forming process rotates the developing roller 13*a*-Y of the yellow developer 13-Y at the same linear velocity as that of the photosensitive drum 10. This is a measure to alleviate the subsequent shock during contact with the photosensitive drum 10.

In step S4-2, once the developing roller 13*a*-Y rotates at the same linear velocity as that of the photosensitive drum 10, the cam 13*b*-Y is driven, and thus the yellow developer 13-Y is moved into the photosensitive drum 10, and the developing roller 13*a*-Y is in contact with the photosensitive drum 10. In such a case, since two rollers such as the developing roller 13*a*-Y and the photosensitive drum 10, rotate at the same linear velocity, due to the difference in the linear velocity, one of the two rollers is not pushed; also, vibration of the two rollers does not occur.

In step S4-3, in this way, after the developing roller 13*a*-Y is in contact with the photosensitive drum 10, the printer controller increases the rotation speed of the developing roller 13*a*-Y such that the toner stained in the developing roller 13*a*-Y is sufficiently moved into the portion of the electrostatic latent image formed on the photosensitive drum 10. In such a case, preferably, the ratio of the linear velocity of the photosensitive drum 10 to that of the developing roller 13*a*-Y is set to be greater than 1:1 and less than 1:1.5 such that the adequate amount of the toner is supplied to the portion of the electrostatic latent image of the photosensitive drum 10.

In step S4-4, when it is judged that developing of a corresponding color is completed, the process advances to step S4-5, where the linear velocity of the developing roller 13*a*-Y is reduced to be the same as that of the photosensitive drum 10. This is a measure to prevent shock which may occur when the two rollers 13*a*-Y and 10 contact each other or when contact is broken off, and to avoid deleterious effects on an image developed on the photosensitive drum 10.

In step S4-6, in a case where the linear velocity of the two rollers 13*a*-Y and 10 is equalized, the cam 13*b* is driven, and thus the yellow developer 13-Y is returned to its original separated position.

In such a case, since the linear velocity of the two rollers 13*a*-Y and 10 are equalized whenever the developing roller 13*a* of the yellow developer 13-Y and the photosensitive drum 10 contact each other or whenever contact is broken off, shock caused by the difference in the linear velocity during attachment and detachment is eliminated. Here, a stepping motor capable of easily controlling speed change is preferably used as a motor for driving the developing roller 13*a*-Y.

In step S5, the yellow image developed thereby is transferred to the transferring belt 14 through the first transferring nip N1.

In step S6, in this way, after the first yellow image is transferred to the transferring belt 14 from the photosensitive drum 10, it is checked whether developing for the next color proceeds or not. Thus, in a case where developing for the next color proceeds, cleaning and anti-electrostatic operations of the photosensitive drum 10 are performed, and then, the above developing is performed. As in the usual case of forming a color image, in a case where all of four colors are developed and overlap, the remaining magenta, cyan, and black developers are selected one by one (step 3), and simultaneously the above developing for a corresponding color is repeated. Then, four colors overlap on the transferring belt 14, and thereby a final color image is completely formed.

Likewise, in a case where the color image is completed on the transferring belt 14, in step S7, the paper is supplied from the paper cassette 16, and the image on the transferring belt 14 is transferred to the paper from the second transferring nip N2.

In step S8, the paper to which the image is transferred passes through the fixing unit 15 and is heated and pressed. In step S9, the paper is discharged outside of the printer body along the transfer path.

Thus, in the above method for forming an image, as above, since the linear velocity of the photosensitive drum 10 should be equalized with that of the developing roller 13*a* whenever the developing roller 13*a* of the developer 13 which is attached and detached from the photosensitive drum 10 is attached and detached, the supply of the toner to the photosensitive drum 10 can be sufficient during development, and simultaneously shock caused by the attaching and detaching operation is alleviated, and thereby the possibility of defective images thereof can be greatly reduced.

As described above, the method for forming an image in an electrophotographic printer according to the present invention can equalize the linear velocity of the developing roller, which is attached and detached from the photosensitive drum, with the linear velocity of the photosensitive drum whenever attachment and detachment occur, and once attachment occurs, the linear velocity of the developing roller is changed to be faster than that of the photosensitive drum, and after developing the linear velocity of the developing roller is changed to be the same as that of the photosensitive drum and thereby the following effects can be obtained.

First, because shock caused by the attaching and detaching operation is alleviated, the toner during development is sufficiently supplied, and defective images resulting from conditions such as registration defects caused by the break off of contact between the developer and the drum and jitter errors caused by vibration, can be suppressed.

Second, because shock during attachment and detachment is alleviated, the toner of the developer is prevented from scattering to peripheral devices due to shock caused by attachment and detachment.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A method for forming an image in an electrophotographic printer, which is capable of removing a developing roller of a developer from a photosensitive medium on which an electrostatic latent image is formed, and of developing the electrostatic latent image with a predetermined color, the method comprising the steps of:

rotating the developing roller at the same non-zero linear velocity as that of the photosensitive medium under a condition in which the developing roller is separated from the photosensitive medium;

moving the developer so that the developing roller is in contact with the photosensitive medium;

changing the linear velocity of the developing roller to be faster than that of the photosensitive medium after contact; and completing the developing of the electrostatic latent image with the predetermined color.

2. The method of claim 1, further comprising the steps of:

rotating the developing roller at the same linear velocity as that of the photosensitive medium after completing developing; and moving the developer so that the developing roller is separated from the photosensitive medium.

3. The method of claim 1, wherein the ratio of the linear velocity of the photosensitive medium to that of the developing roller in the step of developing is greater than 1:1 and less than 1:1.5.

4. The method of claim 1, wherein the photosensitive medium is a photosensitive drum having a cylinder shape.

* * * * *